US011322285B2

(12) United States Patent
Hong et al.

(10) Patent No.: US 11,322,285 B2
(45) Date of Patent: May 3, 2022

(54) INDUCTOR

(71) Applicant: SAMSUNG ELECTRO-MECHANICS CO., LTD., Suwon-si (KR)

(72) Inventors: Seung Hee Hong, Suwon-si (KR); Seung Jae Song, Suwon-si (KR); Jae Woon Park, Suwon-si (KR); Sang Jong Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 723 days.

(21) Appl. No.: 16/275,960

(22) Filed: Feb. 14, 2019

(65) Prior Publication Data

US 2020/0051727 A1 Feb. 13, 2020

(30) Foreign Application Priority Data

Aug. 13, 2018 (KR) ..... 10-2018-0094506

(51) Int. Cl.

| | |
|---|---|
| ***H01F 17/00*** | (2006.01) |
| ***H01F 27/29*** | (2006.01) |
| ***H01F 41/10*** | (2006.01) |
| ***H01F 17/04*** | (2006.01) |

(Continued)

(52) U.S. Cl.

CPC ..... *H01F 17/0013* (2013.01); *H01F 17/04* (2013.01); *H01F 27/245* (2013.01); *H01F 27/29* (2013.01); *H01F 41/041* (2013.01); *H01F 41/10* (2013.01)

(58) Field of Classification Search

CPC ..... H01F 17/0013; H01F 27/29; H01F 41/10

See application file for complete search history.

(56) References Cited

U.S. PATENT DOCUMENTS

2012/0140374 A1* 6/2012 Kawasaki ..... H01G 4/008 361/301.3
2014/0077914 A1* 3/2014 Ohkubo ..... H01F 27/2804 336/177

(Continued)

FOREIGN PATENT DOCUMENTS

JP 6102420 B2 3/2017
KR 10-1999-0049588 A 7/1999
KR 19990049588 A * 7/1999

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

An inductor includes a body including a coil and a dummy electrode, spaced apart from the coil, and having a first side surface and a second side surface disposed to oppose each other in a first direction, a top surface and a bottom surface disposed to oppose each other in a second direction, and a first end surface and a second end surface disposed to oppose each other in a third direction, and external electrodes including a first external electrode, disposed on an external surface of the body, extending from the first end surface to a portion of the bottom surface and a second external electrode, disposed on an external surface of the body, extending from the second end surface to a portion of the bottom surface.

20 Claims, 13 Drawing Sheets

(51) Int. Cl.
*H01F 41/04* (2006.01)
*H01F 27/245* (2006.01)

(56) References Cited

U.S. PATENT DOCUMENTS

2015/0048915 A1* 2/2015 Yoon ..... H01F 17/0013
336/192
2019/0051450 A1* 2/2019 Shimoda ..... H01F 27/30

FOREIGN PATENT DOCUMENTS

KR 20050029927 A * 3/2005
KR 10-0519815 B1 9/2005
KR 20170032057 A * 3/2017

* cited by examiner

INDUCTOR

CROSS-REFERENCE TO RELATED APPLICATION(S)

This application claims the benefit of priority to Korean Patent Application No. 10-2018-0094506 filed on Aug. 13, 2018 in the Korean Intellectual Property Office, the disclosure of which is incorporated herein by reference in its entirety.

TECHNICAL FIELD

The present disclosure relates to an inductor, and more particularly to a chip-type inductor.

BACKGROUND

Recently, smartphones have used signals within many frequency bands due to the application of LTE multiband. Accordingly, an impedance matching circuit is mainly used in high-frequency signal transmission and reception RF systems, and such a high-frequency inductor has been increasingly used.

Such a high-frequency inductor has led to demand for a miniaturized chip inductor product having a high-Q characteristic obtained by improving a Q characteristic which is a quality factor.

SUMMARY

An aspect of the present disclosure is to provide an inductor preventing a corner portion of a body from being damaged when a miniaturized chip inductor having a high-Q characteristic is manufactured.

According to an aspect of the present disclosure, an inductor includes a body including a coil and a dummy electrode, spaced apart from the coil, and having a first side surface and a second side surface disposed to oppose each other in a width direction, a top surface and a bottom surface disposed to oppose each other in a thickness direction, and a first end surface and a second end surface disposed to oppose each other in a length direction, a first external electrode, disposed on an external surface of the body, extending in the length direction from the first end surface to a portion of the bottom surface, and a second external electrode, disposed on an external surface of the body, extending in the length direction from the second end surface to a portion of the bottom surface. The coil includes a first lead-out pattern exposed to an external surface of the body to be connected to the first external electrode and a second lead-out pattern exposed to an external surface of the body to be connected to the second external electrode. The first external electrode includes a first pattern external electrode directly connected to the first lead-out pattern and a first dummy external electrode connected to only the dummy electrode. The second external electrode includes a second pattern external electrode directly connected to the second lead-out pattern and a second dummy external electrode connected to only the dummy electrode. A length of each of the first and second pattern external electrodes extending in the width direction of the body is greater than a length of each of the first and second dummy external electrodes extending in the width direction of the body.

The body may have a structure in which a plurality of magnetic sheets are laminated.

The plurality of magnetic sheets may be laminated in the width direction.

The body may further include a via penetrating through each of the plurality of magnetic sheets.

The first and second external electrodes may be spaced apart in the width direction from a first corner formed by the bottom surface and the first side surface and a second corner formed by the bottom surface and the second side surface, respectively.

The first and second pattern external electrodes may be integrated with the first and second dummy external electrodes into a single body without boundaries therebetween, respectively.

The first and second lead-out patterns may be exposed to the bottom surface of the body.

The dummy electrode may be exposed to the first and second end surfaces and the bottom surface.

The first and second pattern external electrodes may be spaced apart in the width direction from a first corner formed by the bottom surface and the first side surface and a second corner formed by the bottom surface and the second side surface, respectively.

The first and second lead-out patterns may be exposed to the first end surface and the second end surface of the body, respectively.

The dummy electrode may be exposed to the bottom surface and the first and second end surfaces of the body.

The first and second pattern external electrodes may be separated from the first and second dummy external electrodes, respectively.

Each of the first and second pattern external electrodes and the first and second dummy external electrodes may have a rectangular cross section.

The dummy electrode may include a first dummy electrode brought into contact with the first or second pattern external electrode, and a second dummy electrode in contact with the first or second dummy external electrode, in which the first dummy electrode and the second dummy electrode are separated from each other.

First corners formed by the bottom surface and the first end surface of the body and second corners formed by the bottom surface and the second end surface of the body may not be covered by the coil and the first and second external electrodes.

An insulating layer may be disposed on a surface, in a state of non-contact with the first and second external electrodes, among external surfaces of the body.

According to another aspect of the present disclosure, an inductor includes a body including a coil and a dummy electrode, spaced apart from the coil, and having a first side surface and a second side surface disposed to oppose each other in a width direction, atop surface and a bottom surface disposed to oppose each other in a thickness direction, and a first end surface and a second end surface disposed to oppose each other in a length direction, a first external electrode, disposed on an external surface of the body, extending in the length direction from the first end surface to a portion of the bottom surface, and a second external electrode, disposed on an external surface of the body, extending in the length direction from the second end surface to a portion of the bottom surface. The coil includes a first lead-out pattern exposed to an external surface of the body to be connected to the first external electrode and a second lead-out pattern exposed to an external surface of the body to be connected to the second external electrode. The first external electrode includes a first pattern external electrode directly connected to the first lead-out pattern and a first dummy external electrode connected to only the dummy electrode. The second external electrode includes a second pattern external electrode directly connected to the second lead-out pattern and a second dummy external electrode connected to only the dummy electrode. The first and second pattern external electrodes are separated from the first and second dummy external electrodes, respectively.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, examples of the present disclosure will be described as follows with reference to the attached drawings.

Hereinafter, an inductor according to an example will be described, but is not necessarily limited thereto.

First Example

Figure 1:
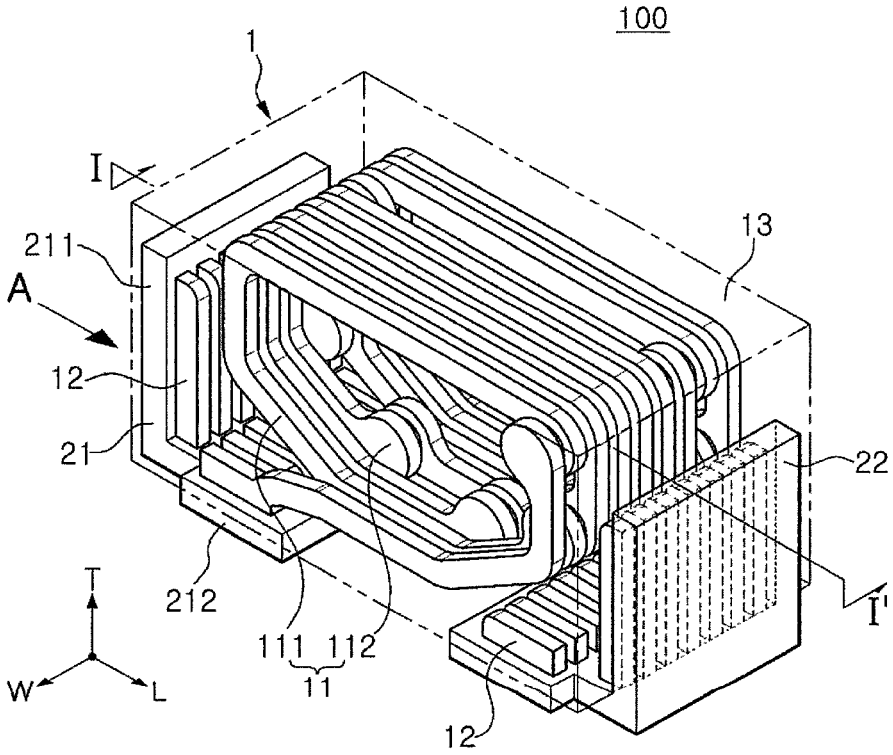
FIG. 1 is a perspective view of an inductor according to a first example.
Figure 2:
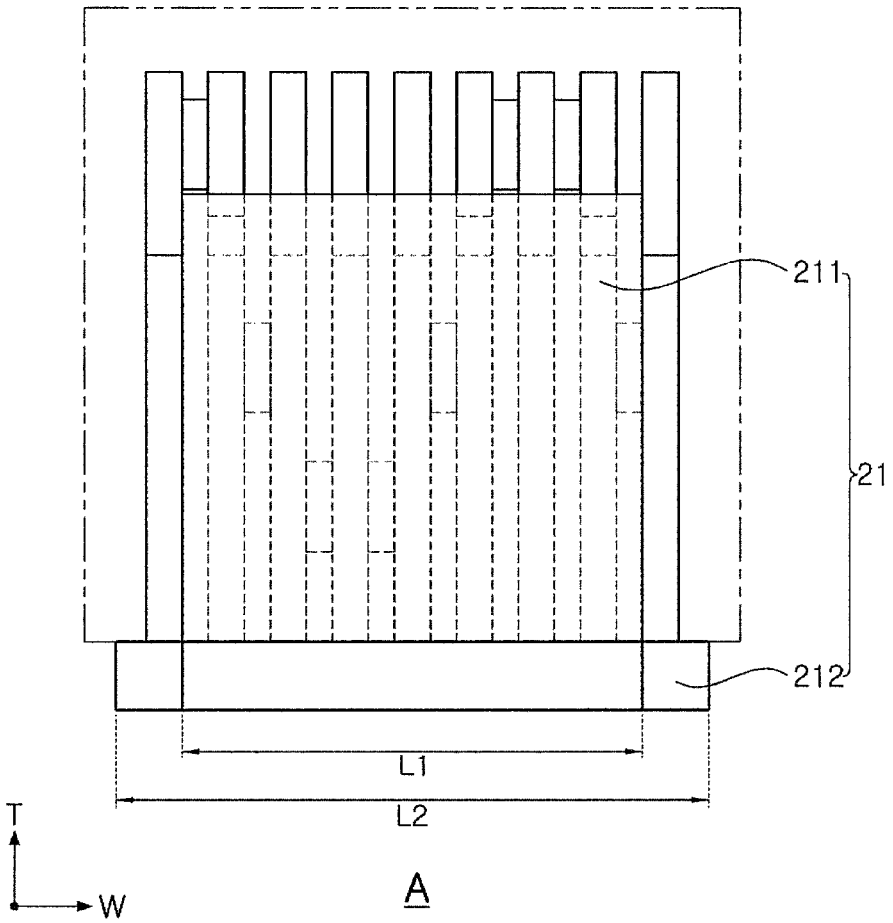
FIG. 2 is a cross-sectional view taken in direction A in FIG. 1.
Figure 3:
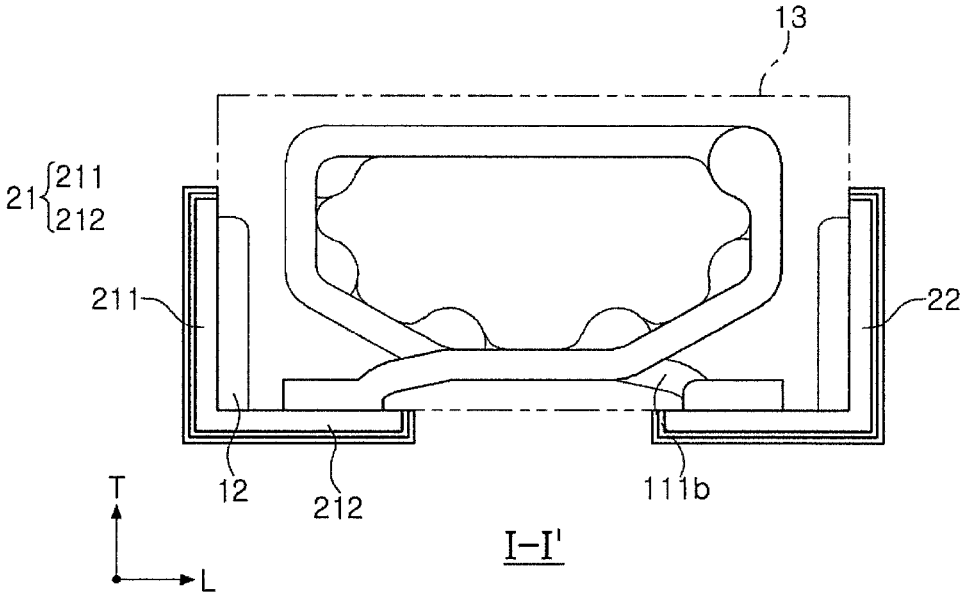
FIG. 3 is a cross-sectional view taken along line I-I' in FIG. 1.
Figure 4:
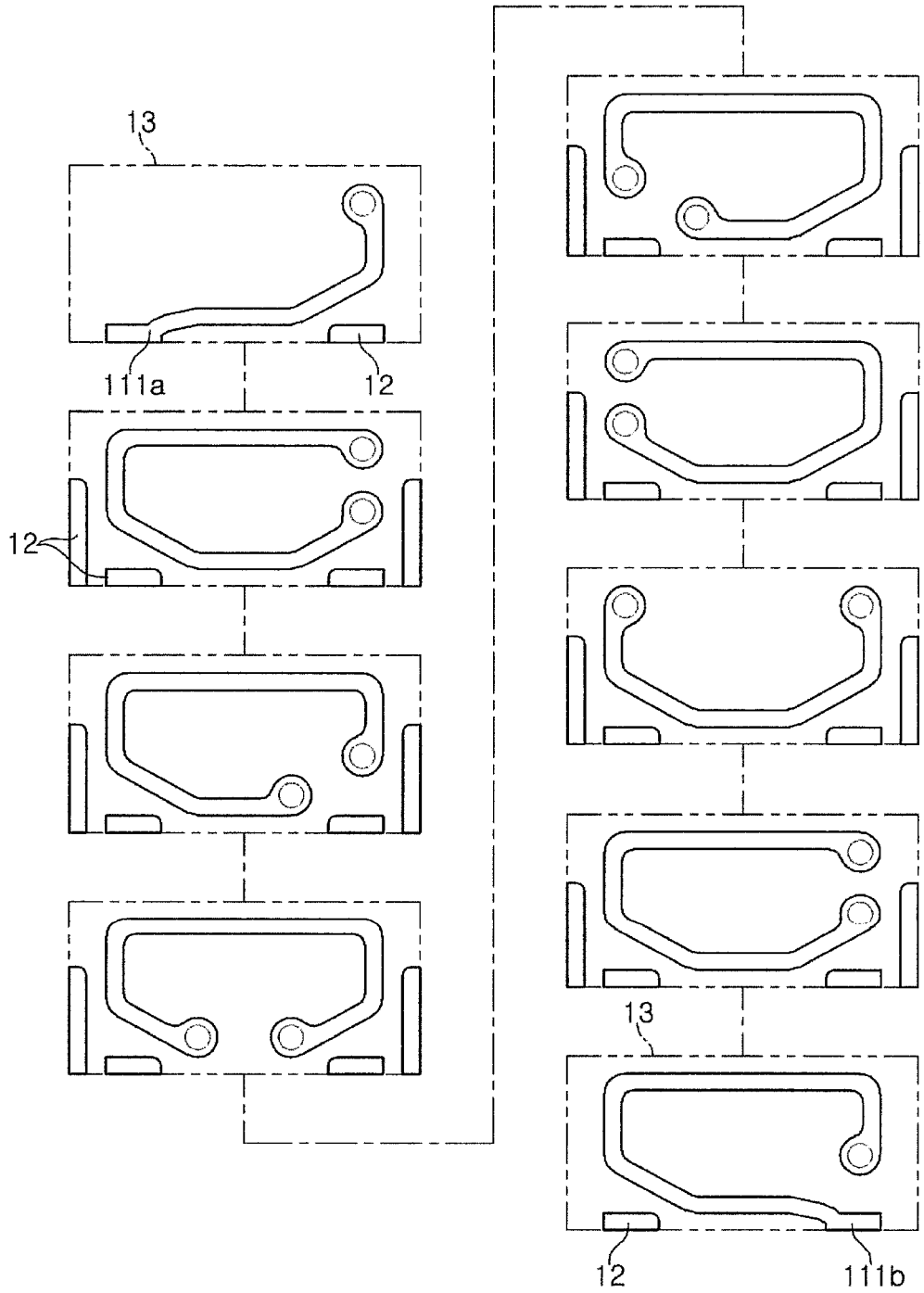
FIG. 4 is an exploded perspective view of FIG. 1.

FIG. 1 is a perspective view of an inductor according to a first example. FIG. 2 is a cross-sectional view taken in direction A in FIG. 1, FIG. 3 is a cross-sectional view taken along line I-I' in FIG. 1, and FIG. 4 is an exploded perspective view of FIG. 1.

Referring to FIGS. 1 to 4, an inductor 100 according to the first example includes a body 1 and external electrodes 21 and 22 disposed on external surfaces of the body 1.

The body 1 includes a coil 11 in the body 1, a dummy electrode 12 disposed to be spaced apart from the coil 11, and a plurality of magnetic sheets 13 disposed to encapsulate the coil 11 and the dummy electrode 12.

The body 1 has top and bottom surfaces disposed to oppose each other in a thickness direction T, first and second end surfaces disposed to oppose each other in a length direction L, and first and second side surfaces disposed oppose each other in a width direction W, and has a hexahedral shape. A plurality of magnetic sheets are laminated in the width direction W of the body 1, which will described later. The width direction W, the thickness direction T, and the length direction L are perpendicular to one another, and may be referred to as a first direction, a second direction, and a third direction, respectively. Also the first direction refers to a direction in which dielectric sheets are laminated.

The coil 11 in the body 1 generally has a spiral shape in which a plurality of coil patterns 111 are connected to each other through a via 112.

The plurality of coil patterns 111 are disposed on the plurality of magnetic sheets 13, and the plurality of magnetic sheets 13 are integrated with each other so that boundaries therebetween are not readily apparent in an ultimate body structure.

The plurality of coil patterns 111 include a first lead-out pattern 111*a* connected to the first external electrode 21 and a second lead-out pattern 111*b* connected to the second external electrode 22, and the first and second lead-out patterns 111*a* and 111*b* correspond to coil patterns farthest spaced apart from each other in a direction in which magnetic sheets are laminated.

Referring to FIG. 4, the first lead-out pattern 111*a* is led to a bottom surface of the body. Similarly, the second lead-out pattern 111*b* is led to the bottom surface of the body.

Since the first lead-out pattern 111*a* is electrically connected to the first external electrode 21 and the second lead-out pattern 111*b* is electrically connected to the second external electrode 22, both the first and second external electrodes 21 and 22 are disposed on the bottom surface of the body to constitute an inductor including a bottom electrode. For ease of description, in FIGS. 1 to 4, each of the first and second external electrodes 21 and 22 has a single-layer structure. However, as needed by those skilled in the art to implement the present disclosure, each of the first and second external electrodes 21 and 22 may have a multilayer structure and may include copper wire plating, a nickel (Ni) plating layer, and a tin (Sn) plating layer. It is a matter of course that each of the first and second external electrodes 21 and 22 includes an additional external electrode layer including a conductive resin, as needed.

A coil further includes a dummy electrode 12 spaced apart from a coil pattern disposed on each magnetic sheet, and the dummy electrode 12 may be disposed to be exposed to first and second end surfaces and a bottom surface of the body.

The dummy electrode 12 is connected to an external electrode such that connectivity between the external electrode and the body is enhanced to reinforce structural strength.

The first external electrode 21 disposed on the first end surface and the bottom surface of the body will be described with reference to FIG. 2. The first external electrode 21 is connected to the dummy electrode 12 on the first end surface and connected to the first lead-out pattern 111*a* or the dummy electrode 12 on the bottom surface. It is a matter of course that the dummy electrode 12 connected to the first external electrode 21 on the bottom surface refers to a dummy electrode exposed to the bottom surface of the body.

The first external electrode 21 includes a first dummy external electrode 211 disposed on the first end surface of the body to extend to a portion of the bottom surface of the body and a first pattern external electrode 212 disposed on the bottom surface of the body. The first dummy external electrode 211 and the first pattern external electrode 212 are connected to each other and integrated into a single body.

When the first dummy external electrode 211, disposed on the first end surface to extend to a portion of the bottom surface of the body, extends in a width direction, a length of the first dummy external electrode 211 is denoted by L1. When the first pattern external electrode 212, disposed on the bottom surface of the body, extends in the width direction, a length of the first pattern external electrode 212 is denoted by L2. The length L1 is less than the length L2. Substantially the same contents are applied to the second external electrode, but detailed description of the second external electrode will be omitted for ease of description.

The first dummy external electrode 211, disposed on the first end surface to extend to a portion of the bottom surface of the body, is connected to the dummy electrode 12, and the first pattern external electrode 212, disposed on the bottom surface of the body, is connected to a first lead-out pattern and a dummy electrode. In consideration of this, such a structure is effective to further increase a contact area between a coil pattern and a first pattern external electrode 212 connected to a coil pattern, including a first lead-out pattern, substantially related with capacitance of a coil.

On the other hand, a length L1 of the first dummy external electrode 211, connected to only the dummy electrode 12, in a width direction is less than a length L2 of the first pattern external electrode 212 also connected to the first lead-out pattern. Therefore, both end portions (circular portions indicated by dotted lines) of a corner disposed between the bottom surface and the first end surface of the body are not covered with an external electrode, which means that a dummy electrode or a coil patterns is not exposed to both the end portions of the corner.

As a result, during a dicing process of fabricating an inductor, possibility of cracking occurring in both the end portions of the corner may be significantly reduced. Specifically, when both the end portions of the corner have a short length, cracking frequently occurs on the corner during the dicing process. Therefore, a length in a width direction, in which a dummy electrode or a coil pattern is disposed, from both the end portions of the corner is sufficiently secured to prevent the cracking.

Figure 5:
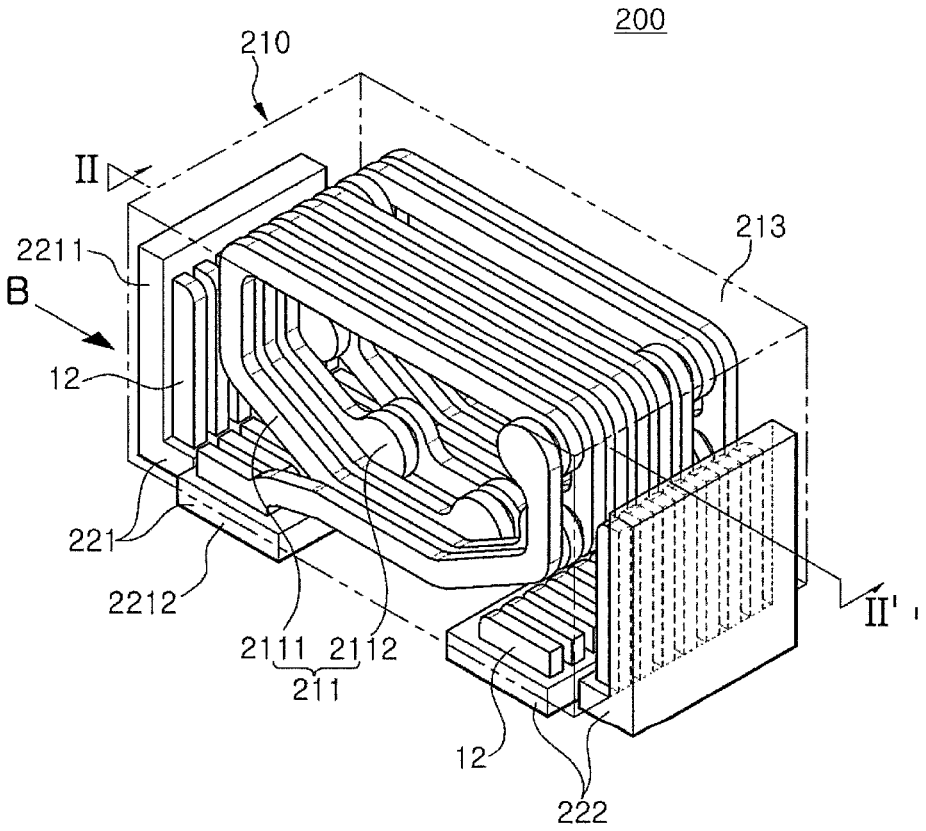
FIG. 5 is a perspective view of an inductor according to a second example.
Figure 6:
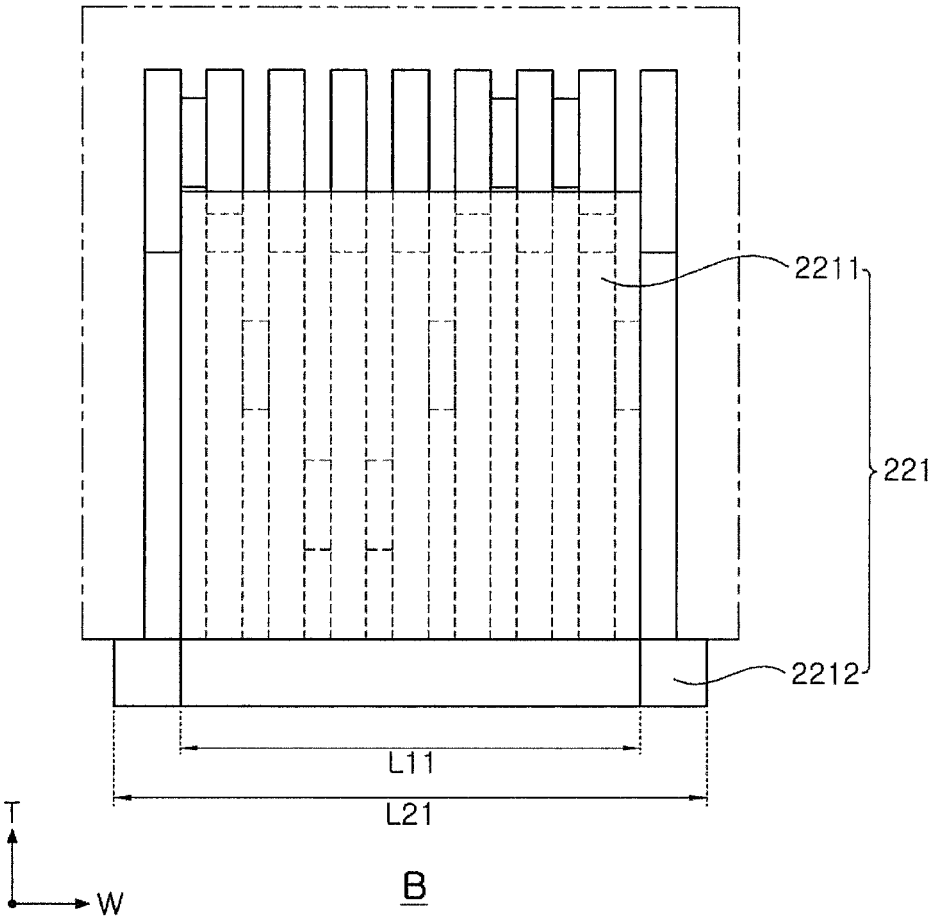
FIG. 6 is a cross-sectional view taken in direction B in FIG. 5.

FIG. 5 is a perspective view of an inductor according to a second example. FIG. 6 is a cross-sectional view taken in direction B in FIG. 5, and FIG. 7 is a cross-sectional view taken along line II-II' in FIG. 5.

Figure 7:
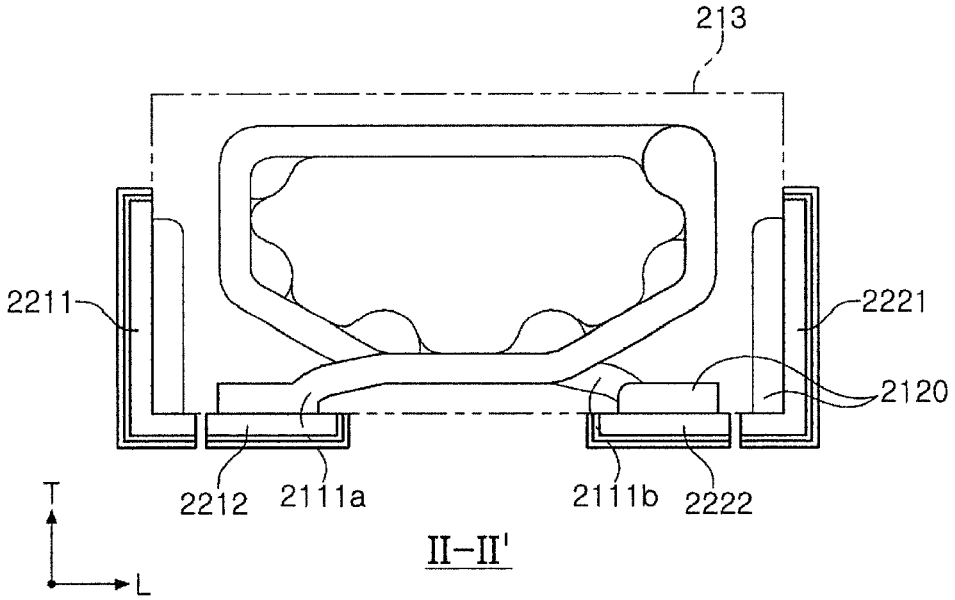
FIG. 7 is a cross-sectional view taken along line II-II' in FIG. 5.

Referring to FIGS. 5 to 7, an inductor 200 according to the second example includes a body 210 and external electrodes 221 and 222.

Compared with the inductor 100 according to the first example, the inductor 200 according to the second example include first and second external electrodes 221 and 222, each including at least two external electrodes separated from each other. Different parts between the first and second examples will be described, while a description of the same parts thereof will be omitted for ease of description.

Referring to FIGS. 6 and 7, a first external electrode 221 includes a first dummy external electrode 2211 extending from a first end surface to a portion of a bottom surface and a first pattern external electrode 2212 disposed on only the bottom surface. A length L11 of the first dummy external electrode 2211 extending in a width direction is less than a length L21 of the first pattern external electrode 2212 extending in a width direction. In this case, the first external electrode 221 is not disposed on both end portions of a corner disposed between a bottom surface and a first end surface of a body, which means that the length L11 of the first dummy external electrode 2211 disposed from the both the end portions of the corner in the width direction is sufficiently secured.

Similarly to the inductor 100 according to the first example, the inductor 200 according to the second example allows formation of a coil pattern, a dummy electrode, or an external electrode on both the end portions of the corner of the body 210 to be omitted, preventing cracking from occurring during a dicing process. Moreover, each of the first and second external electrodes 221 and 222 includes at least two external electrodes such as a dummy external electrode and a pattern external electrode. Thus, a length of a lead-out pattern may be reduced to decrease an Rdc value.

Figure 8:
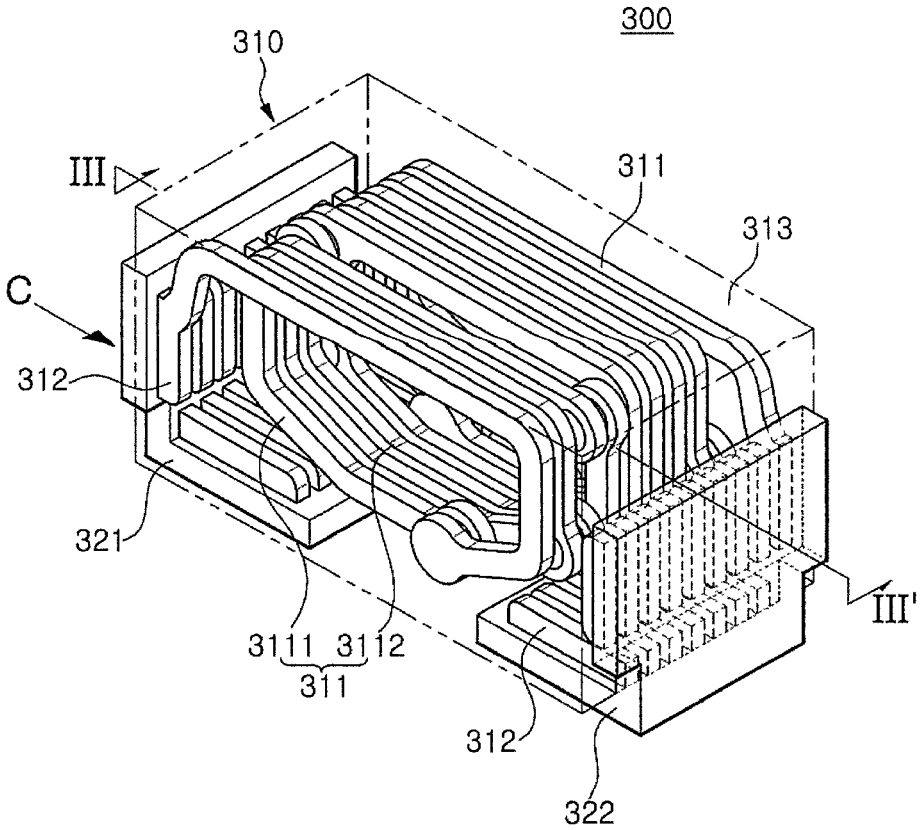
FIG. 8 is a perspective view of an inductor according to a third example.
Figure 9:
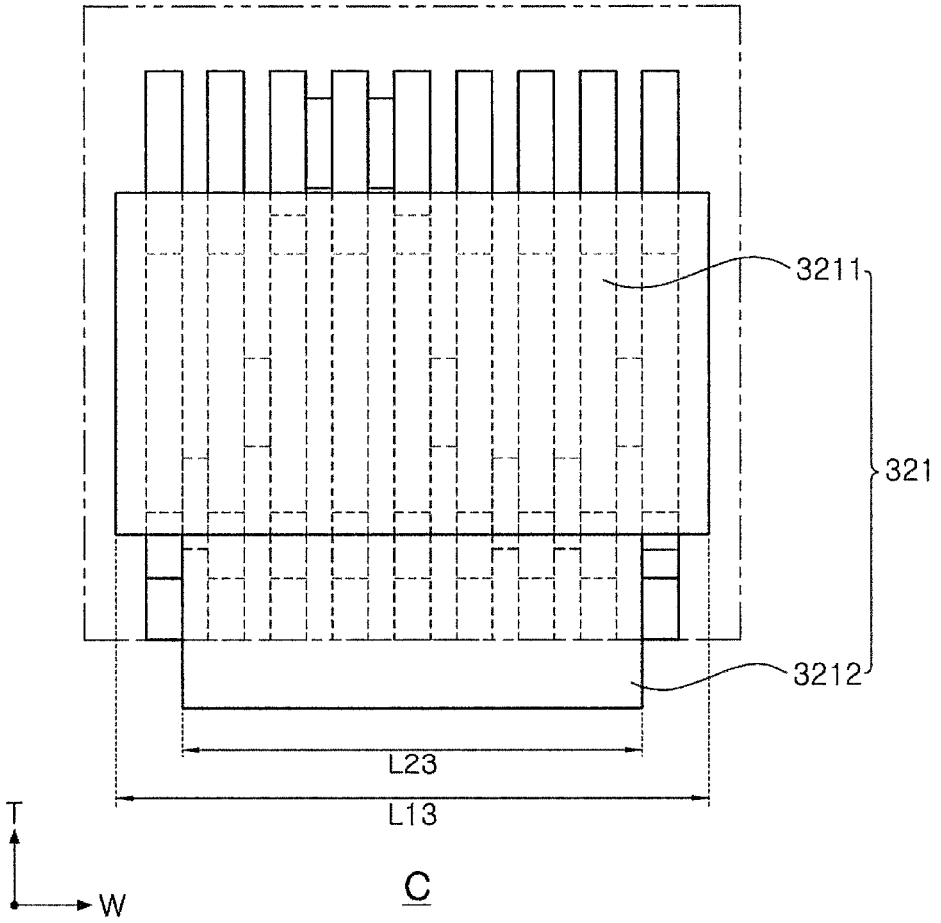
FIG. 9 is a cross-sectional view taken in direction C in FIG. 8.
Figure 10:
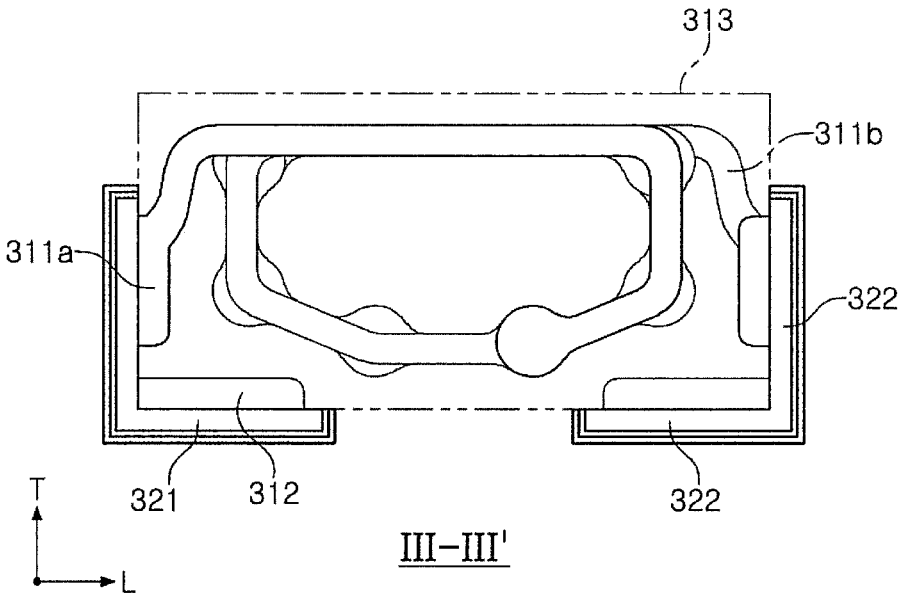
FIG. 10 is a cross-sectional view taken along line III-III' in FIG. 8.

FIG. 8 is a perspective view of an inductor according to a third example. FIG. 9 is a cross-sectional view taken in direction C in FIG. 8, FIG. 10 is a cross-sectional view taken along line III-III' in FIG. 8, and FIG. 11 is an exploded perspective view of FIG. 8.

Referring to FIGS. 8 to 11, an inductor 300 according to the third example includes a coil pattern and an external electrode having different shapes from those of the inductors 100 and 200 according to the first and second examples.

Figure 11:
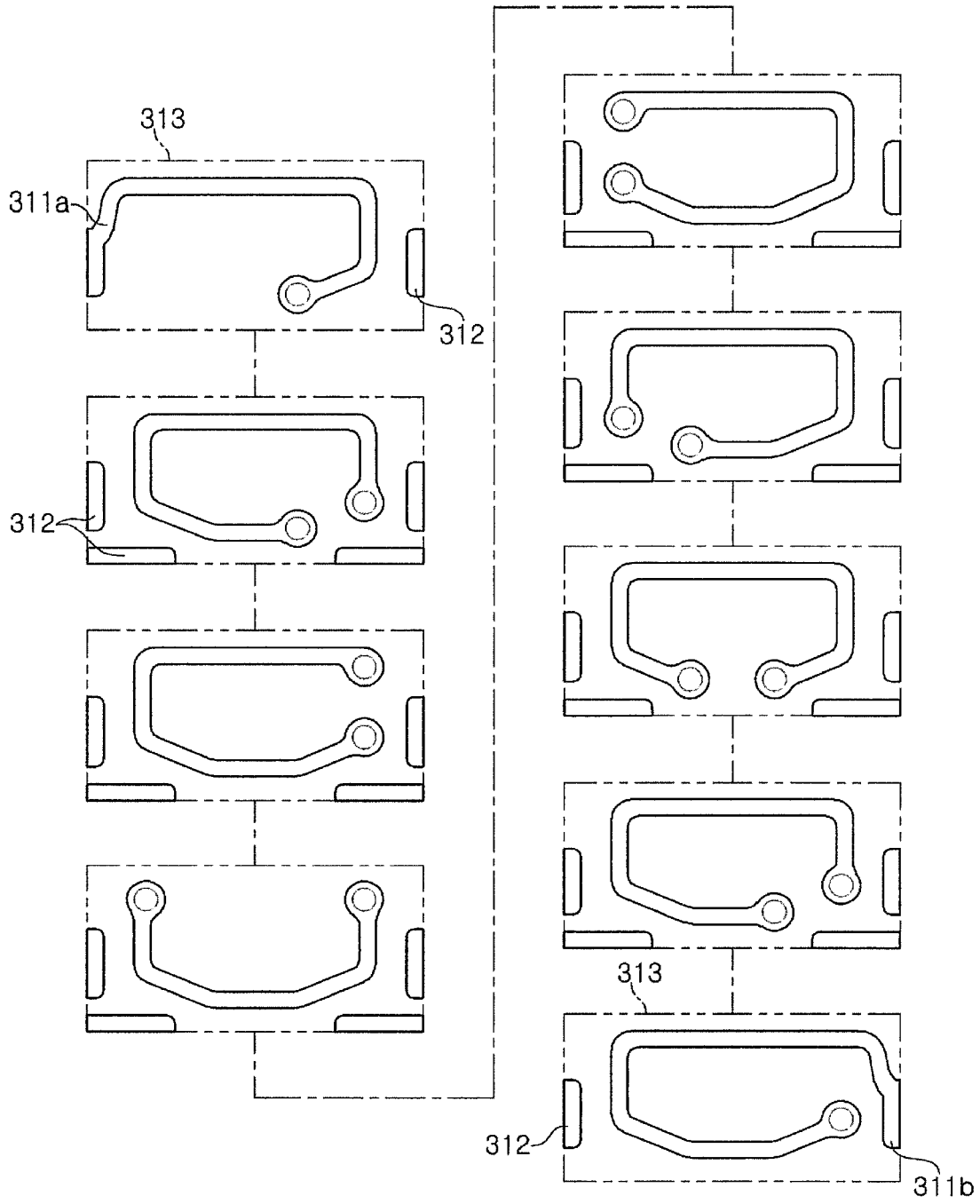
FIG. 11 is an exploded perspective view of FIG. 8.

Referring to FIG. 11, among a plurality of coil patterns 311, a first lead-out pattern 311*a* connected to a first external electrode 321 and a second lead-out pattern 311*b* connected to a second external electrode 322 are led to a first end surface and a second end surface, respectively.

A dummy electrode 312 spaced apart from a coil is exposed to a bottom surface, and the first and second end surfaces of the body. In this case, a dummy electrode exposed to the bottom surface of the body, a dummy electrode exposed to the first end surface, and a dummy electrode exposed to the second end surface are spaced apart from each other.

The first external electrode 321 includes a first pattern external electrode 3211 disposed on the first end surface of the boy to be connected to the first lead-out pattern 311*a* and a first dummy external electrode 3212 connected to a dummy electrode. In this case, the first pattern external electrode is also connected to the dummy electrode exposed to the first end surface.

Since the first pattern external electrode and the first dummy external electrode are connected to each other and integrated into a single body, they are not apparently distinguished from each other.

A length L13 of the first pattern external electrode 3211 extending in a width direction is greater than a length L23 of the first dummy external electrode 3212 extending in a width direction. This allows a length of a first pattern external electrode, directly connected to a first lead-out pattern, in a width direction to be relatively greater than a length of a first dummy external electrode in a width direction. Accordingly, a dummy electrode or a coil pattern is not formed on both end portions of a corner disposed between the bottom surface and the first end surface of the body, while enhancing possibility of significantly increasing capacitance. As a result, cracking may be prevented from occurring during a dicing process.

Figure 12:
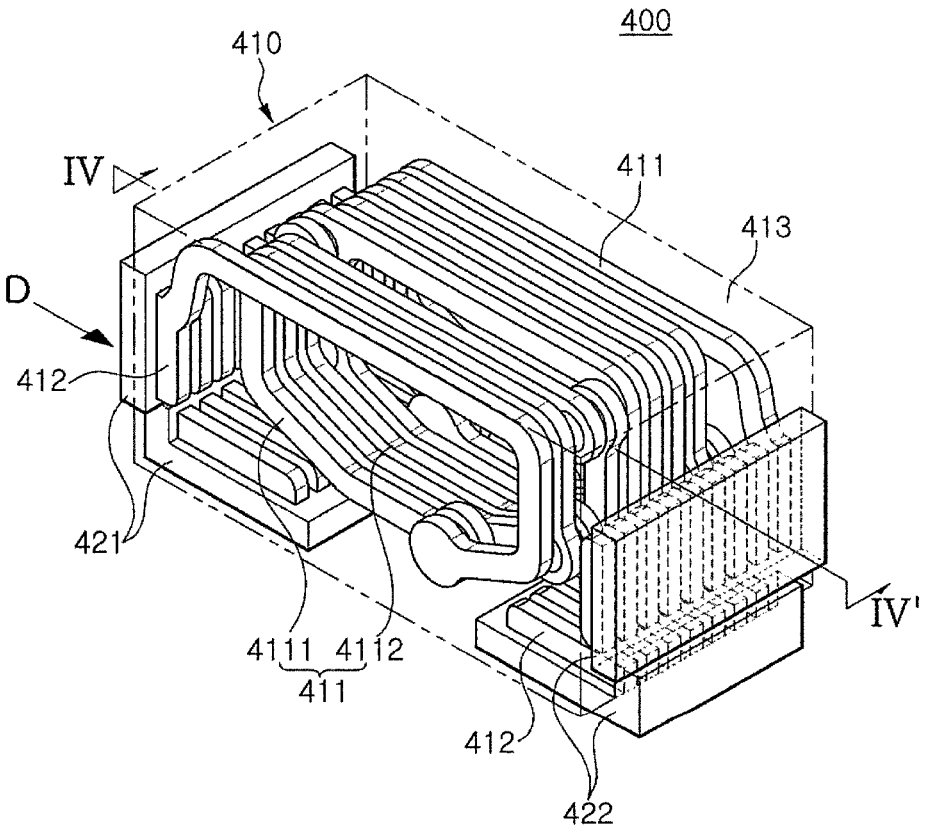
FIG. 12 is a perspective view of an inductor according to a fourth example.
Figure 13:
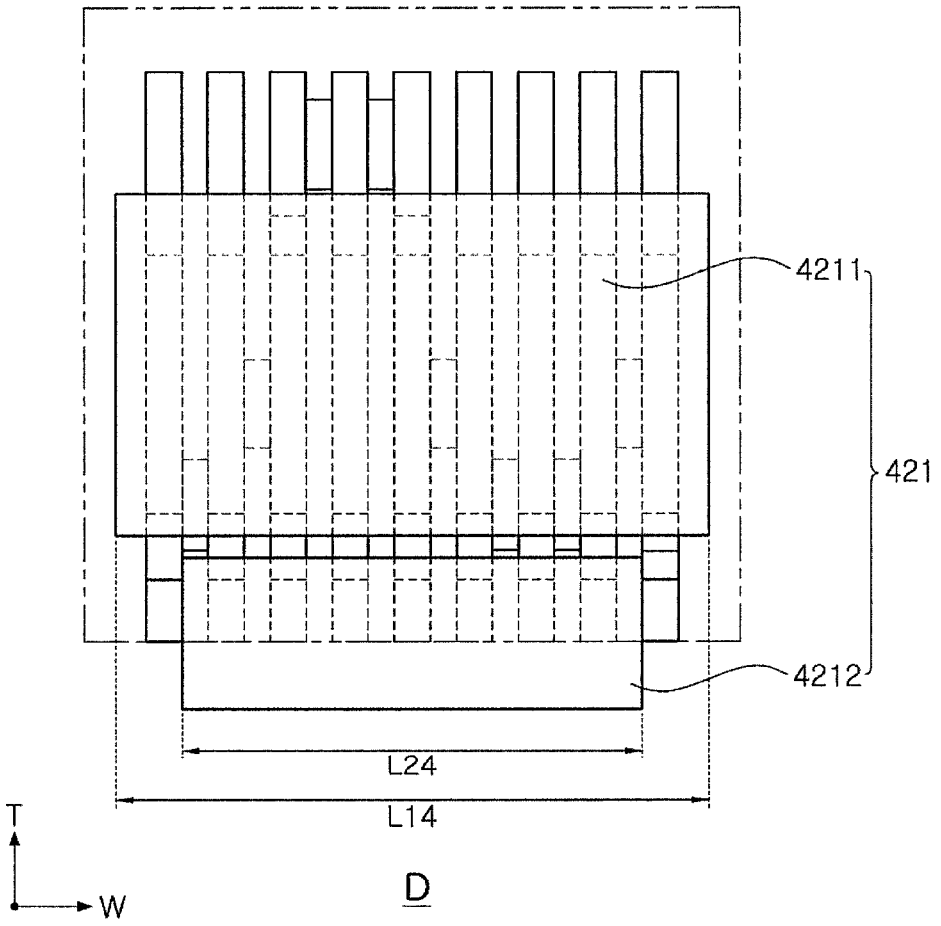
FIG. 13 is a cross-sectional view taken in direction D in FIG. 12.

FIG. 12 is a perspective view of an inductor according to a fourth example. FIG. 13 is a cross-sectional view taken in direction D in FIG. 12, and FIG. 14 is a cross-sectional view taken along line IV-IV' in FIG. 12.

Figure 14:
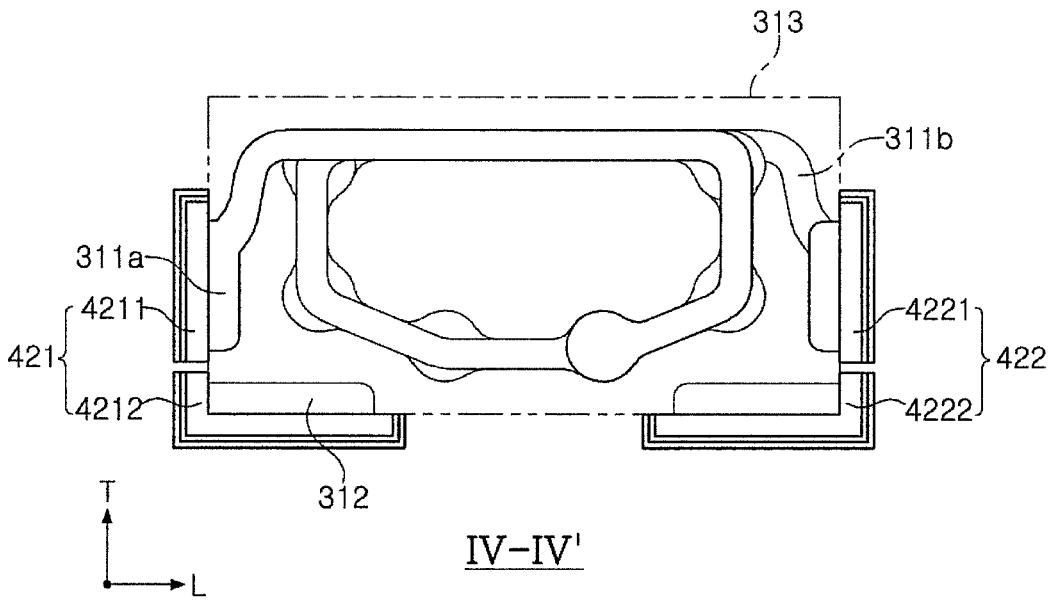
FIG. 14 is a cross-sectional view taken along line IV-IV' in FIG. 12.

Compared with the inductor 300 according to the third example, an inductor illustrated in FIGS. 12 to 14 includes substantially duplicate components, except that respective first and second external electrodes 421 and 422 are separated from each other.

Referring to FIG. 13 or 14, a first external electrode 421 includes a first pattern external electrode 4211 disposed on a first end surface of a body and a first dummy external electrode 4212 extending to the first end surface and a bottom surface of the body. In this case, the first pattern external electrode 4211 and the first dummy external electrode 4212 are spaced apart from each other to be separated from each other.

Since first pattern external electrode 4211 and the first dummy external electrode 4212 are spaced apart from each other to be separated from each other, a length of a first lead-out pattern may be decreased to reduce resistance characteristics of a coil.

A second external electrode 422 is spaced apart from the first external electrode 421 in a length direction to be symmetrical with respect to each other, and is substantially identical to the first external electrode 421. Thus, duplicate explanations thereof will be omitted.

According to the above-described inductor, lengths of first and second external electrodes, connected to first and second lead-out patterns, in a width direction are less than lengths of first and second external electrodes, connected to first and second dummy electrodes, in a width direction, respectively. Due to such a structure, high capacitance may be implemented and a coil pattern or a dummy pattern may not formed on both end portions of a corner disposed on a bottom surface and a first end surface and on both end portions of a corner disposed between the bottom surface and a second end surface. Thus, cracking is prevented from occurring during a dicing process to improve reliability.

One of various effects of an inductor according to an example is to implement a high-Q characteristic and chip-type reliability.

While examples have been shown and described above, it will be apparent to those skilled in the art that modifications and variations could be made without departing from the scope of the present invention as defined by the appended claims.

What is claimed is:

1. An inductor comprising:

a body including a coil and a dummy electrode, spaced apart from the coil, and having a first side surface and a second side surface disposed to oppose each other in a width direction, a top surface and a bottom surface disposed to oppose each other in a thickness direction, and a first end surface and a second end surface disposed to oppose each other in a length direction;

a first external electrode, disposed on an external surface of the body, extending in the length direction from the first end surface to a portion of the bottom surface; and a second external electrode, disposed on an external surface of the body, extending in the length direction from the second end surface to a portion of the bottom surface, wherein the coil includes a first lead-out pattern exposed to an external surface of the body to be connected to the first external electrode and a second lead-out pattern exposed to an external surface of the body to be connected to the second external electrode, the first external electrode includes a first pattern external electrode directly connected to the first lead-out pattern and a first dummy external electrode connected to only the dummy electrode, the second external electrode includes a second pattern external electrode directly connected to the second lead-out pattern and a second dummy external electrode connected to only the dummy electrode, and a length of each of the first and second pattern external electrodes extending in the width direction of the body is greater than a length of each of the first and second dummy external electrodes extending in the width direction of the body.

2. The inductor of claim 1, wherein the body has a structure in which a plurality of magnetic sheets are laminated.

3. The inductor of claim 2, wherein the plurality of magnetic sheets are laminated in the width direction.

4. The inductor of claim 2, wherein the body further includes a via penetrating through each of the plurality of magnetic sheets.

5. The inductor of claim 1, wherein the first and second external electrodes are spaced apart in the width direction from a first corner formed by the bottom surface and the first side surface and a second corner formed by the bottom surface and the second side surface, respectively.

6. The inductor of claim 1, wherein the first and second pattern external electrodes are respectively integrated with the first and second dummy external electrodes as a single body without boundaries therebetween.

7. The inductor of claim 1, wherein the first and second lead-out patterns are exposed to the bottom surface of the body.

8. The inductor of claim 1, wherein the dummy electrode is exposed to the first and second end surfaces and the bottom surface.

9. The inductor of claim 6, wherein the first and second pattern external electrodes are spaced apart in the width direction from a first corner formed by the bottom surface and the first side surface and a second corner formed by the bottom surface and the second side surface, respectively.

10. The inductor of claim 1, wherein the first and second lead-out patterns are exposed to the first end surface and the second end surface of the body, respectively.

11. The inductor of claim 10, wherein the dummy electrode is exposed to the bottom surface and the first and second end surfaces of the body.

12. The inductor of claim 1, wherein the first and second pattern external electrodes are separated from the first and second dummy external electrodes, respectively.

13. The inductor of claim 12, wherein each of the first and second pattern external electrodes and the first and second dummy external electrodes has a rectangular cross section.

14. The inductor of claim 12, wherein the dummy electrode includes a first dummy electrode brought into contact with the first or second pattern external electrode, and a second dummy electrode in contact with the first or second dummy external electrode, wherein the first dummy electrode and the second dummy electrode are separated from each other.

15. The inductor of claim 1, wherein first corners formed by the bottom surface and the first end surface of the body and second corners formed by the bottom surface and the second end surface of the body are not covered by the coil and the first and second external electrodes.

16. The inductor of claim 1, wherein an insulating layer is disposed on a surface, in a state of non-contact with the first and second external electrodes, among external surfaces of the body.

17. An inductor comprising:

a body including a coil and a dummy electrode, spaced apart from the coil, and having a first side surface and a second side surface disposed to oppose each other in a width direction, a top surface and a bottom surface disposed to oppose each other in a thickness direction, and a first end surface and a second end surface disposed to oppose each other in a length direction;

a first external electrode, disposed on an external surface of the body, extending in the length direction from the first end surface to a portion of the bottom surface; and a second external electrode, disposed on an external surface of the body, extending in the length direction from the second end surface to a portion of the bottom surface, wherein the coil includes a first lead-out pattern exposed to an external surface of the body to be connected to the first external electrode and a second lead-out pattern exposed to an external surface of the body to be connected to the second external electrode, the first external electrode includes a first pattern external electrode directly connected to the first lead-out pattern and a first dummy external electrode connected to only the dummy electrode, the second external electrode includes a second pattern external electrode directly connected to the second lead-out pattern and a second dummy external electrode connected to only the dummy electrode, and the first and second pattern external electrodes are separated from the first and second dummy external electrodes, respectively.

18. The inductor of claim 17, wherein a length of each of the first and second pattern external electrodes extending in the width direction of the body is greater than a length of each of the first and second dummy external electrodes extending in the width direction of the body.

19. The inductor of claim 1, wherein the first and second lead-out patterns are exposed to the bottom surface of the body.

20. The inductor of claim 1, wherein the first and second lead-out patterns are exposed to the first end surface and the second end surface of the body, respectively.

* * * * *